US005651606A

United States Patent [19]

Krogman

[11] Patent Number: 5,651,606

[45] Date of Patent: Jul. 29, 1997

[54] OUTDOOR LIGHT FIXTURE WITH DRAINAGE FEATURES

[75] Inventor: Mark J. Krogman, Southlake, Tex.

[73] Assignee: Greenlee Lighting, Carrollton, Tex.

[21] Appl. No.: 496,083

[22] Filed: Jun. 28, 1995

[51] Int. Cl.[6] ..... F21V 31/02

[52] U.S. Cl. ..... 362/96; 362/267; 362/311; 362/359; 362/371; 362/375

[58] Field of Search ..... 362/96, 153, 153.1, 362/267, 359, 431, 285, 310, 311, 371, 374, 375

[56] References Cited

U.S. PATENT DOCUMENTS

| | | | |
|---|---|---|---|
| Re. 34,709 | 8/1994 | Tyson | 362/96 |
| D. 124,540 | 1/1941 | Nebenzahl et al. | D26/104 |
| D. 149,124 | 3/1948 | Hewitt | D26/63 |
| D. 152,113 | 12/1948 | Mehr | D24/210 |
| D. 172,523 | 6/1954 | Stone | D26/138 |
| D. 173,139 | 10/1954 | Black | D26/138 |
| D. 207,866 | 6/1967 | DeVos et al. | D26/63 |
| D. 222,556 | 11/1971 | Mattson | D26/138 |
| D. 234,712 | 4/1975 | Kennedy et al. | D26/63 |
| D. 263,000 | 2/1982 | Heritage et al. | D26/63 |
| D. 264,386 | 5/1982 | Heritage et al. | D26/63 |
| D. 286,682 | 11/1986 | Greenlee | D26/63 |
| D. 291,604 | 8/1987 | Watson | D26/68 |
| D. 293,940 | 1/1988 | Lasker | D26/60 |
| D. 294,179 | 2/1988 | Lasker | D26/65 |
| D. 303,719 | 9/1989 | Lasker et al. | D26/65 |
| D. 315,964 | 4/1991 | Joosten et al. | D26/63 |
| D. 316,911 | 5/1991 | Hazerjian et al. | D26/67 |
| D. 317,509 | 6/1991 | Hazerjian et al. | D26/67 |
| D. 322,862 | 12/1991 | Miller | D26/63 |
| D. 323,897 | 2/1992 | Compton | D26/24 |
| D. 329,101 | 9/1992 | Lendefeld | D26/68 |
| D. 330,947 | 11/1992 | Donato et al. | D26/85 |
| D. 337,835 | 7/1993 | Donato et al. | D26/24 |
| D. 338,736 | 8/1993 | Compton et al. | D26/74 |
| D. 343,021 | 1/1994 | Compton et al. | D26/74 |
| D. 352,124 | 11/1994 | Russello et al. | D26/63 |
| D. 355,044 | 1/1995 | Russello et al. | D26/85 |
| 1,325,619 | 12/1919 | Clemmans | 362/359 |
| 1,968,072 | 7/1934 | Creighton | 362/101 |
| 3,193,674 | 7/1965 | Fleming | 362/430 |
| 3,213,273 | 10/1965 | Zagel | 362/431 |
| 3,360,642 | 12/1967 | DeVos et al. | 362/285 |
| 3,560,728 | 2/1971 | Atkin | 362/294 |
| 3,679,892 | 7/1972 | Shearer | 362/306 |
| 3,786,248 | 1/1974 | Compton | 362/296 |
| 4,041,306 | 8/1977 | Compton et al. | 362/297 |
| 4,064,432 | 12/1977 | Compton et al. | 362/457 |
| 4,079,559 | 3/1978 | Tenbrummeler | 52/295 |
| 4,118,767 | 10/1978 | Urbanek | 362/455 |
| 4,131,867 | 12/1978 | Quiogue | 336/65 |
| 4,143,413 | 3/1979 | Kelly | 362/431 |
| 4,231,080 | 10/1980 | Compton | 362/298 |
| 4,290,098 | 9/1981 | Pierson | 362/267 |
| 4,344,118 | 8/1982 | Rundquist et al. | 362/267 |
| 4,388,677 | 6/1983 | Druffel | 362/276 |
| 4,399,497 | 8/1983 | Druffel | 362/362 |
| 4,405,974 | 9/1983 | Quiogue | 362/362 |

(List continued on next page.)

*Primary Examiner*—Alan Cariaso
*Attorney, Agent, or Firm*—Wood, Herron & Evans

[57] ABSTRACT

The light fixture of the invention comprises a housing defining an interior space with an open end and a socket for supporting a lamp bulb to shine a beam out of the open end. A lens fits over the open end and closes the housing and the lens retaining ring engages the lens and secures the lens to the housing to seal the interior space. A plurality of drainage ducts are formed in the lens retaining ring and communicate with an outer face surface of the lens to receive and drain water away from the lens and prevent water accumulation and obstruction of the beam. A flange on the retaining ring cooperates with the housing to form a groove surrounding the open end which receives a glare shield ridge for securement of the glare shield without additional fasteners. Unique compression disks limiting sealing structure seal the open end of the housing as well as the housing interface with an adjustable arm. One embodiment of the light fixture utilizes an end cap which is sealed with similar compression disk limiting structure.

19 Claims, 3 Drawing Sheets

U.S. PATENT DOCUMENTS

| | | | |
|---|---|---|---|
| 4,432,045 | 2/1984 | Merritt | 362/375 |
| 4,453,203 | 6/1984 | Pate | 362/345 |
| 4,471,416 | 9/1984 | Druffel | 362/430 |
| 4,473,873 | 9/1984 | Quigue | 362/404 |
| 4,489,368 | 12/1984 | Sangiamo et al. | 362/368 |
| 4,499,527 | 2/1985 | Tauber et al. | 362/267 |
| 4,510,557 | 4/1985 | Tsuyama | 362/188 |
| 4,511,114 | 4/1985 | Druffel et al. | 248/546 |
| 4,521,836 | 6/1985 | Puttemanns et al. | 362/267 |
| 4,523,263 | 6/1985 | Poyer | 362/456 |
| 4,564,890 | 1/1986 | Poyer | 362/216 |
| 4,566,057 | 1/1986 | Druffel | 362/364 |
| 4,595,971 | 6/1986 | Dean | 362/345 |
| 4,651,260 | 3/1987 | Lasker | 362/281 |
| 4,694,382 | 9/1987 | Sales | 362/346 |
| 4,701,832 | 10/1987 | Lasker | 362/281 |
| 4,713,737 | 12/1987 | Lasker et al. | 362/285 |
| 4,760,511 | 7/1988 | Russello et al. | 362/427 |
| 4,763,233 | 8/1988 | Poyer | 362/267 |
| 4,768,139 | 8/1988 | Poppenheimer | 362/302 |
| 4,789,932 | 12/1988 | Sales | 362/346 |
| 4,870,548 | 9/1989 | Beachy et al. | 362/145 |
| 4,907,139 | 3/1990 | Quiogue | 362/153 |
| 4,931,914 | 6/1990 | Quiogue | 362/265 |
| 4,931,915 | 6/1990 | Quiogue | 362/267 |
| 4,947,307 | 8/1990 | Quiogue | 362/325 |
| 5,016,151 | 5/1991 | Mula | 362/267 |
| 5,072,344 | 12/1991 | Fabbri | 362/150 |
| 5,075,831 | 12/1991 | Stringer et al. | 362/365 |
| 5,086,379 | 2/1992 | Denison et al. | 362/145 |
| 5,122,936 | 6/1992 | Guthrie | 362/101 |
| 5,149,282 | 9/1992 | Donato et al. | 439/530 |
| 5,183,330 | 2/1993 | Rishel et al. | 362/372 |
| 5,183,331 | 2/1993 | Edgell et al. | 362/426 |
| 5,207,499 | 5/1993 | Vajda et al. | 362/96 |
| 5,211,473 | 5/1993 | Gordin et al. | 362/297 |
| 5,222,800 | 6/1993 | Chan et al. | 362/147 |
| 5,249,109 | 9/1993 | Denison et al. | 362/285 |
| 5,249,110 | 9/1993 | Russello et al. | 362/294 |
| 5,251,118 | 10/1993 | Budnovitch et al. | 362/362 |
| 5,258,898 | 11/1993 | Thornton | 362/394 |
| 5,260,860 | 11/1993 | Jordan et al. | 362/431 |
| 5,289,357 | 2/1994 | Fabbri | 362/223 |
| 5,307,254 | 4/1994 | Russello et al. | 362/368 |
| 5,309,341 | 5/1994 | Russello et al. | 362/300 |
| 5,311,416 | 5/1994 | Maurice | 362/362 |
| 5,317,493 | 5/1994 | Muller et al. | 362/407 |
| 5,339,234 | 8/1994 | Russello et al. | 362/419 |
| 5,349,510 | 9/1994 | Jordan et al. | 362/374 |
| 5,374,812 | 12/1994 | Chan et al. | 220/3.6 |
| 5,381,322 | 1/1995 | Humphreys | 362/220 |
| 5,386,356 | 1/1995 | Davis, Jr. et al. | 362/267 |
| 5,394,316 | 2/1995 | Holbrook et al. | 362/294 |
| 5,408,397 | 4/1995 | Tyson | 362/267 |

OUTDOOR LIGHT FIXTURE WITH DRAINAGE FEATURES

FIELD OF THE INVENTION

The present invention relates generally to light fixtures and specifically to outdoor light fixtures which are exposed to the environment and are utilized as floodlights or spotlights to accent buildings and other structures.

BACKGROUND OF THE INVENTION

Outdoor light fixtures are utilized for a variety of purposes, such as spotlights or floodlights to illuminate a chosen area or to accent a building or some other structure. For example, outdoor light fixtures are used around houses to shine generally on the front facade of the house and thereby accent the architectural features of the house. Outdoor lights are also utilized at the base of trees, flagpoles and other environmental structures, to illuminate and accent the structures for decorative purposes. Such lights are also utilized to illuminate a remote area for the purposes of safety.

Outdoor light fixtures are exposed to the environment and therefore are generally constructed to withstand moisture, such as dew, rain or water from a sprinkler system. The construction of an outdoor light fixture generally comprises a partially dosed housing, open at one end, which is coupled to an adjustable support. The housing holds a lamp bulb which shines a beam out of the open end of the housing onto the illuminated structure. The housing may be adjusted angularly on the support such that the beam strikes the structure at a chosen angle. A transparent glass lens is usually placed over the open end of the housing to dose and seal the housing such that water and moisture cannot enter and affect the operation of the lamp. While available light structures are sufficiently sealed to keep water from entering, they do not address problems associated with the accumulation of water on the outside of the housing, and especially the accumulation of water on the lens.

Light fixtures which are utilized to illuminate a tall house, a tree, or a flagpole are usually positioned at the base of the structure and are pointed almost directly upwardly to cast a beam along a portion of the height of the structure. When the fixture is pointed straight up, the lens and open end of the housing are generally horizontally disposed and will collect dew, rainwater or water from sprinklers. The water generally accumulates on and around the lens and will eventually evaporate due to the heat of the lens caused by the lamp beam. As may be appreciated, water accumulating on the lens creates a greater risk of penetration into the inside of the light fixture because it will not evaporate immediately. However, the primary concern is blockage of the beam by the accumulated water. Dew, rain water and tap water, contain suspended minerals and dirt, and upon the eventual evaporation of water, the mineral and dirt deposits are left as film on the lens. The mineral deposits and dirt cover the transparent lens and thus attenuate the strength of the lamp beam passing therethrough. Therefore, lenses of outdoor light fixtures require continual maintenance and cleaning to ensure proper lighting and operation of the fixtures.

Attempts have been made to utilize convex-shaped lenses which have face surfaces curving outwardly from the fixture housing open end. While a convex lens may drain some of the water away from the lens and prevent some deposits thereon, a portion of the lens will usually accumulate water and be obstructed. Furthermore, the accumulation of water may be such that the convex lens surface is completely submerged in the accumulated water. Additionally, convex-shaped glass lenses are usually made of pressed glass which is substantially more expensive than fiat plate glass lenses and thus substantially drives up the cost of the fixtures. Therefore, it is one objective of the present invention to prevent the accumulation of water on the light fixture lens and to thereby prevent deposits of mineral and dirt thereon. It is another objective of the present invention to provide an unobstructed lamp beam which shines on the chosen structure to be illuminated. Still further, it is an objective to prevent the deposit of minerals and dirt even when inexpensive, fiat plate glass lenses are utilized with the light fixture.

While some available outdoor light fixtures are adequately sealed to prevent the entry of water and moisture to the inside of the fixture, many utilize fiat gaskets as sealing structures. The fiat gaskets are pressed between a housing surface and a surface of some other element, such as the lens or another fixture element. The components are then secured together and tightened to compress the fiat gasket and provide a seal of the fixture. However, because the seal is determined by the tightness of the components, persons assembling the fixtures are subject to over tightening various pieces. The gaskets are often over-compressed, thus jeopardizing their construction and operation. The sealing structures of available fixtures are also susceptible to being over-tightened to the point of crushing the gasket such that it will not provide proper sealing. Alternatively, the sealing gasket may not be compressed enough, thus compromising the sealing of the light fixture housing. Therefore, it is another objective of the present invention to properly seal a light fixture whereupon all of the seals of the fixture are consistently and properly tightened to provide proper sealing.

Outdoor light fixtures are often utilized with glare shields which are placed around the open end of the housing next to the lens. The glare shields deflect a portion of the lamp beam and focus the beam to further illuminate a selected portion of an illuminated structure. Conventional glare shields, however, must be specially attached during construction of the fixture or must be subsequently fixed to the fixture with separate fastening structures. This makes field-retrofitting of an existing light fixture difficult because extra pieces are necessary and are subject to being misplaced or not readily available. Furthermore, the additional parts increase the cost of the fixture. Since glare shields surround the open end of the fixture of the lens, they also have a tendency to increase the accumulation of water on the lens. Accordingly, it is another objective of the present invention to provide a light fixture with a glare shield which may be quickly and readily attached without additional fastening parts or complicated procedures. It is further an objective to prevent the accumulation of water on the lens of the light fixture even when a glare shield has been attached thereto.

SUMMARY OF THE INVENTION

The present invention addresses the above-discussed objectives and provides an improved lighting fixture for outdoor use. A light fixture comprises a housing which defines an interior space therein having an open end. The interior of the housing supports a socket which receives a lamp bulb such that the beam of the lamp bulb shines out of the open end of the housing. A lens is configured to fit over the open end of the housing to dose the housing and is made of a transparent material such as glass to allow the lamp beam to pass therethrough and shine out the end of the fixture. The lens may be formed of relatively inexpensive flat plate glass or might be formed to have a convex shape curving outwardly from the open end. The lens is held against the housing open end by a lens retaining ring. The lens retaining ring secures the lens to the housing and seals the interior space to protect the lamp bulb from exposure to water and other moisture.

To prevent the accumulation of water on the lens and the subsequent buildup of mineral and dirt deposits, the invention further comprises a plurality of drainage ducts which are formed in the lens retaining ring and extend radially outwardly from the center of the ring. The ducts are arranged at a plurality of positions around the ring which are preferably equally spaced therearound to allow for proper drainage around the entire lens. The drainage ducts contact a flat perimeter surface of the lens at the outer face surface of the lens. The ducts receive the water which flows on the outer face surface and drains the water through the retaining ring and away from the lens face surface to prevent water accumulation on the lens and obstruction of the beam passing through the lens. In a preferred embodiment of the invention, the lens retaining ring includes an inner wall which contacts the perimeter surface of the lens and an outer wall which contacts an annular surface surrounding the housing open end. The ducts include inner and outer portions formed in the inner and outer walls, respectively, which are aligned and cooperate to drain water away from the lens face surface and away from the housing so that the water is completely removed from the fixture.

The light fixture of the invention is sealed from water and moisture by a plurality of unique compression-limiting sealing structures. One such compression-limiting sealing structure comprises a channel formed around the perimeter of the housing open end. A compressible seal, preferably in the form of a rubber ring or gasket, rests within the channel. The channel includes inner and outer walls and the compressible seal preferably has a cross-sectional dimension which is greater than the height of the walls. A perimeter portion of the back face surface of the lens spans the channel and compresses the seal in the channel to seal the open end of the housing when the lens is secured to the housing by the retaining ring. To prevent over-tightening of the fixture components and the seal, the channel walls contact the lens surface portion and limit the compression of the seal such that proper and consistent compression is always insured by assembling the light fixture and securing the lens to the housing with the retaining ting. The compression-limiting design prevents over-compression of the seal and crushing of the seal. Furthermore, the unique design of the compression-limiting sealing structure provides an effective housing seal which is neither too loose nor too tight and is thus properly compressed simply by assembly of the housing, lens and lens retaining ring.

One embodiment of the present invention utilizes an open rear end opposite the open end through which the beam passes. The light fixture further comprises a cap which covers and seals the open rear end. In accordance with the principles of the present invention, the cap includes a channel which is formed around a perimeter surface thereof and a compressible seal, similar to the seal previously mentioned, which rests within the channel. The channel includes walls which contact a sealing surface around the open rear end when the cap and housing are assembled. The channel thus prevents over-tightening and provides proper and consistent compression of the seal upon assembly of the cap and housing.

The light fixture of the invention utilizes a movable support arm which is coupled to the fixture housing for adjusting the angular orientation of the housing and controlling the direction of the beam. One surface of the adjustable support arm includes ratchet teeth which cooperate with ratchet teeth on the housing to provide rotational adjustment of the housing with respect to the support arm. A channel is formed in the housing generally coaxially with the ratchet teeth and includes channel walls which contact a sealing surface of the support arm when the arm is coupled to the housing. The channel walls and sealing surface limit the compression of a compressible seal in the channel so that proper and consistent compression is maintained. Therefore, the fixture is sealed at both ends and also at the support arm to provide a watertight construction which is able to withstand the moisture and rigors of an outdoor environment.

The present invention further comprises a glare shield which surrounds the open end of the housing to intercept a portion of the beam and focus the beam to a desired location. In accordance with the principles of the invention, the glare shield may be attached to the light fixture without any additional fastening structures. Therefore, the glare shield may be easily and readily retrofitted to an existing light fixture. To that end, the lens retaining ring includes an outwardly extending flange which surrounds the ring. The ring flange extends from the outer wall of the retaining ring and cooperates with the annular surface of the housing to form a groove around the housing open end. The glare shield includes an inwardly extending ridge which is configured to fit within the groove formed by the retaining ring in the housing. To install the glare shield, the shield is simply held against the housing annular surface and the retaining ring is attached, thus sealing the housing and holding the glare shield in place without additional fasteners. The glare shield ridge moves within the channel and may be rotated 360° before the retaining ring is tightened.

The invention further comprises a plurality of ducts which are formed in the housing and are aligned with the outer portions of the retaining ring draining ducts. The housing ducts are formed proximate the glare shield groove and provide drainage of water from the lens surface even when the glare shield is attached to the light fixture and the glare shield ridge is positioned within the groove. Therefore, the glare shield of the invention may be utilized without jeopardizing the water drainage function of the invention.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
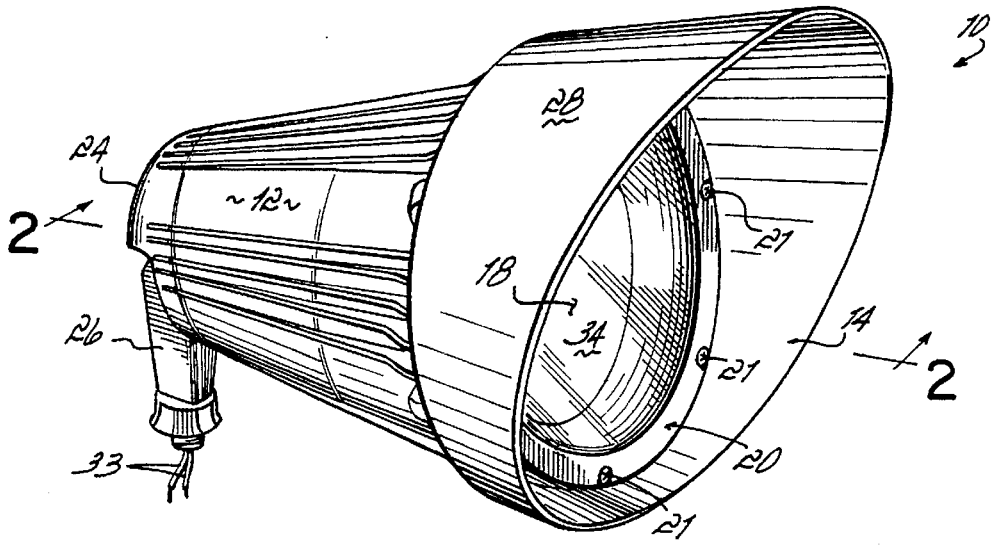
FIG. 1 is a perspective view of one embodiment of the light fixture of the invention.

FIG. 1 is a perspective view of one embodiment of the light fixture 10 of the present invention. Light fixture 10 comprises a housing 12 which is generally a sealed unit but has an open end 14. Like conventional outdoor light fixtures, housing 12 has a socket 15 supported therein which holds a lamp bulb 16 and the lamp bulb is oriented such that the beam, indicated by reference numeral 30, shines out the open end 14 of the housing 12 (see FIG. 2). A lens 18 covers the open end 14 of the housing and is secured in place by a lens retaining ring 20 which is fixed to the housing with screws 21 or other suitable fasteners. The lens is preferably glass or dear plastic so that the lamp beam shines therethrough and may have a smooth surface or a grid pattern (not shown) formed thereon for diffracting the light. The embodiment of the invention illustrated in FIG. 1 has an open rear end 22 which is closed and sealed by an end cap 24. An adjustable support arm 26 is coupled to the end cap 24 so that the angular orientation of the light fixture 10 may be adjusted to selectively direct the beam of the lamp. Light fixture 10 also includes a detachable glare shield 28 for further focusing the beam 30 of the lamp 16 and preventing glare from the open end of the light fixture.

Figure 2:
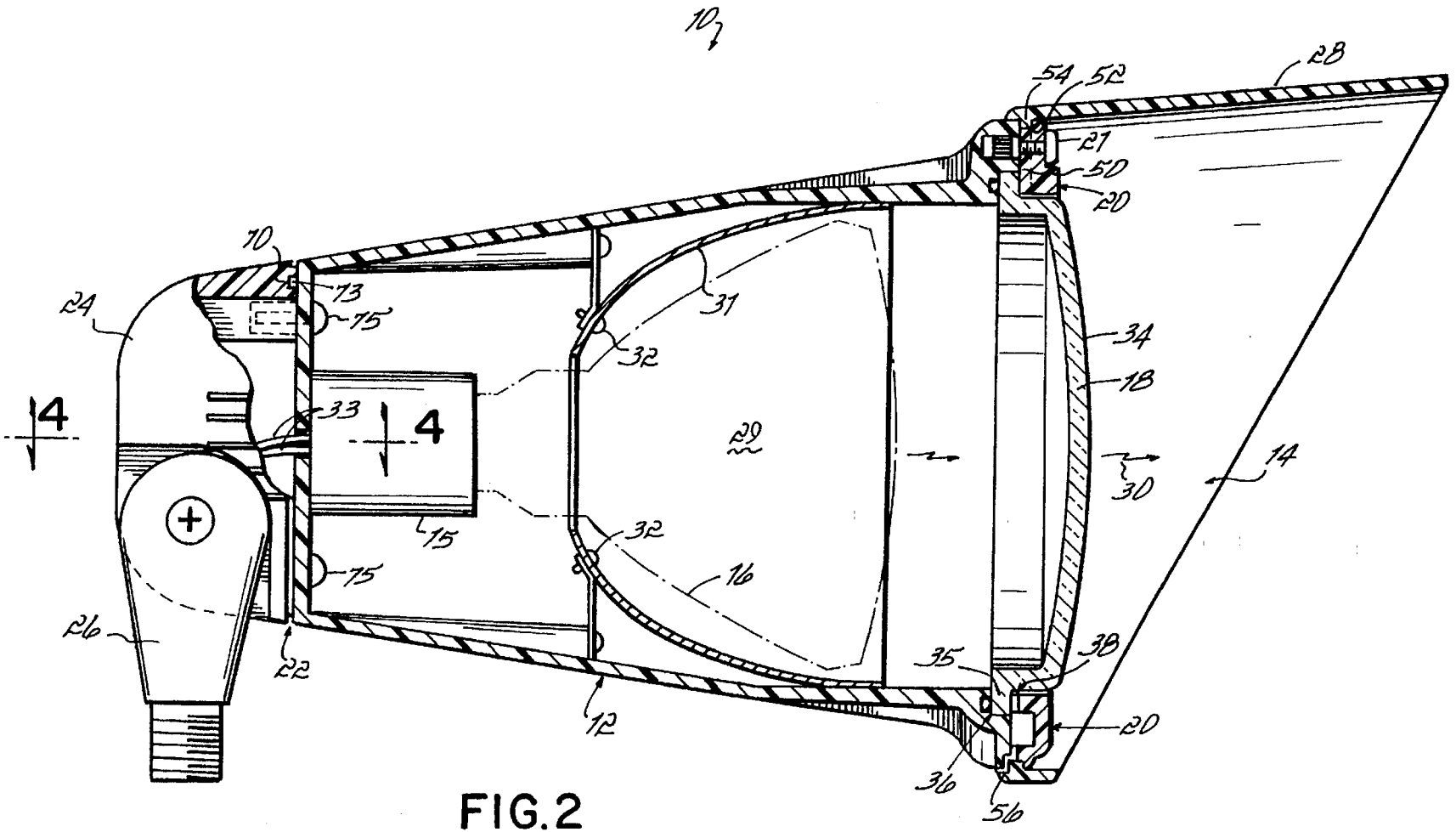
FIG. 2 is a cross-section taken generally along lines 2—2 of FIG. 1.

Referring now to FIG. 2, housing 12 is generally dosed and forms an interior space 29 which houses socket 15 and bulb 16 such that the lamp beam 30 is directed out of the open end 14 of housing 12. Lamp bulb 16 may be self-reflectorized (as is the bulb 16 shown in FIG. 2) for focusing the lamp beam 30 out of housing 12. Alternatively, bulb 16 might be a non-reflector bulb (not shown) in which case, an external reflector, such as reflector 31, must be fixed around the bulb 16 inside housing 12 by appropriate fasteners 32. Socket 15 is connected to wires 33 which extend through arm 26 to an appropriate AC power source (see FIG. 4).

Figure 3:
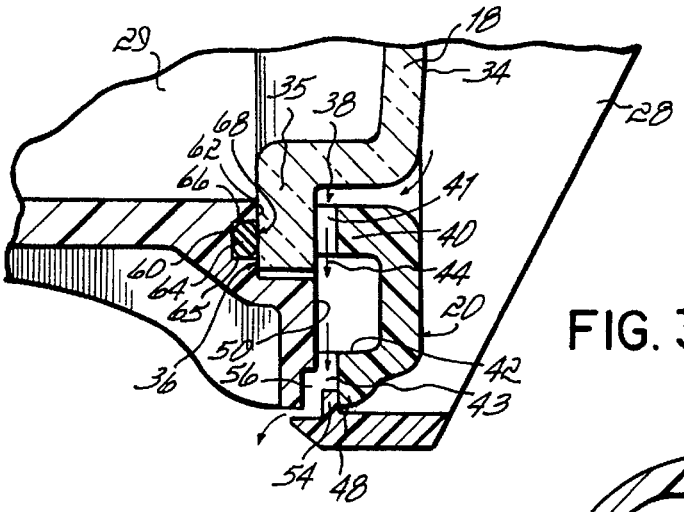
FIG. 3 is an enlarged view of the drainage feature and compression-limiting sealing structure.

The retaining ring 20 of fixture 10 is operable to drain water away from the outer face surface 34 of lens 18. Lens 18 has a convex outer face surface 34 and a perimeter rim 35 which is held between the retaining ring 20 and a sealing surface 36 which surrounds the housing open end 14. Retaining ring 20 includes a plurality of water drainage duds 38 which drain water from face surface 34. Referring to FIG. 3, retaining ring 20 includes an inner wall 40 and an outer wall 42. Drainage duct 38 has an inner portion 41 which extends through inner wall 40 and an outer portion 43 which extends through outer wall 42. The inner and outer portions 41, 43 are outwardly radially aligned to provide for direct flow of water from face surface 34 to the perimeter rim 35 and through the drainage ducts 38 and out away from light fixture 10, as indicated by arrows 44.

The inner duct portion 41 is in contact with lens rim 35 so that water flowing from the face surface 34 to the rim 35 is immediately drained away from the lens. The inner duet portion 41 is also configured to lie fiat against the face surface 34 for rapid, unobstructed drainage. The drainage ducts 38 are spaced at several positions around ring 20, preferably at 60° intervals around ring 20, to provide for sufficient draining of the light fixture. The drainage ducts 38 of the present invention remove water from the lens and thus prevent the accumulation of dirt, mineral deposits, and other obstructions on the outer face surface 34. The lens face surface 34 remains clean and the beam 30 of the light fixture is not obstructed. This is particularly important when the light fixture is focused upwardly such that the lens 18 is essentially horizontal because the lens retaining ring 20 and the glare shield 28 will have a tendency to trap water so that it stays over the face surface 34 until it evaporates from the heat of the lens 18. Light fixtures are often arranged to extend straight upwardly such as to accent houses, flagpoles, and trees.

The embodiment of the light fixture 10 illustrated in FIG. 2 utilizes a pressed glass lens 18 which has a convex outer face surface 34. While the convex outer face surface 34 aids in partially draining water away from the face surface, such shaped glass lenses are formed of pressed glass and are relatively expensive, thus dramatically increasing the cost of the light fixture 10. Furthermore, a large accumulation of water, such as that caused by a heavy storm or constant watering by a sprinkler, may still be trapped by the lens retaining ring 20 and glare shield 28 such that the convex face surface 34 is submerged. The drainage ducts of the present invention not only enhance the operation of a light fixture with a convex lens, but also provides proper water drainage for a light fixture utilizing a relatively inexpensive, flat, plate glass lens, such as lens 46 illustrated in FIG. 5. A flat, plate glass lens 46 is often not suitable for conventional light fixtures because of the high amount of water accumulation. However, the water drainage ducts 38 of the present invention provide suitable drainage for such a fiat lens 46, thereby substantially driving down the overall cost of the light fixture.

Light fixture 10 also utilizes a glare shield 28 which may be attached around open end 14 without additional fastening structures. The glare shield illustrated in the Figures has a longer length dimension on one side than the other to give it a generally triangular cross-section as illustrated in FIG. 2 for focusing or directing the beam 30 more from one side than the other. However, any suitable glare shield might be utilized with the present invention. In accordance with the principles of the invention, the lens retaining ring 20 includes an outwardly extending flange 48 which depends radially outwardly from the outer wall 42 of retaining ring 20. The housing 12 includes an annular surface 50 which surrounds the open end 14. When retaining ring 20 is fixed to housing 12 to secure lens 18, the flange 48 and annular surface 50 cooperate to form a groove 50 also surrounding the housing open end 14. The glare shield 28 has an inwardly extending ridge 54 around its perimeter which fits into groove 52 to secure the glare shield 28 to the fixture housing 12. Ridge 54 is preferably a continuous ridge, but might also be a plurality of spaced-apart smaller ridges. Ridge 54 moves within the groove 52 so that the glare shield 28 may be rotated 360° for proper direction of beam 30. The unique cooperating groove 52 and ridge 54 allows the glare shield 28 to be attached to fixture 10 without external fasteners and thus allows the glare shield to be readily and easily retrofitted to the light fixture in the field without concern about having the proper fasteners or clips at hand or special tools for attaching such fasteners. Instead, shield 28 is held against the open end and the retaining ring is attached to hold the shield 28 in place.

Further in accordance with the principles of the present invention, the annular surface 50 of the housing includes a plurality of drainage ducts 56 formed therein which are positioned radially around the annular surface 50 to partially overlap with the outer duct portions 43 of the retaining ring drainage ducts 38. As illustrated in FIG. 3, water flows through ducts 38 and then through the ducts 56, around ridge 54, and out away from housing 12. Thereby, the water will properly drain from the lens face surface 34 even when the glare shield 28 is attached to the fixture.

Light fixture 10 is sealed with unique compression-limiting sealing structures to prevent water and moisture from entering the interior space 29 of housing 12. Referring to FIGS. 2 and 3, one such compression-limiting sealing structure comprises a channel 60 formed in a sealing surface 62 which surrounds open end 14 and is spaced radially inside of annular surface 50. A compressible seal 64, which is preferably a rubber gasket having a circular cross-section, rests within channel 60 and is contained on either side by opposing channel walls 65, 66. The channel walls 65, 66 are dimensioned in height such that the depth of channel 60 is slightly less than the cross-sectional dimension of seal 64. Therefore,10 in the light fixture 10 is unassembled, the seal 64 will protrude slightly from channel 60. When the lens 18 is fixed to the housing open end 14 by retaining ring 20, surface 68 of the perimeter lens rim 35 compresses the seal 64 into channel 60. The channel walls 65, 66 engage surface 68 and thereby limit the compression of the seal. The height of channel walls 65 and 66 are dimensioned such that proper and consistent compression of the seal 64 is provided simply by securing the lens 18 to housing 12. Regardless of how tight the retaining ring 20 is secured, the compression of seal 64 will always be limited by the channel walls 65, 66 to a proper compression. In that way, the seal 64 is never over-tightened or crushed. Furthermore, seal 64 is never under-compressed because proper compression is achieved whenever the lens rim 35 is properly seated and secured by retaining ring 20. Thereby, the open end 14 of the light fixture 10 is properly sealed to prevent water from seeping into the interior space 29.

Figure 4:
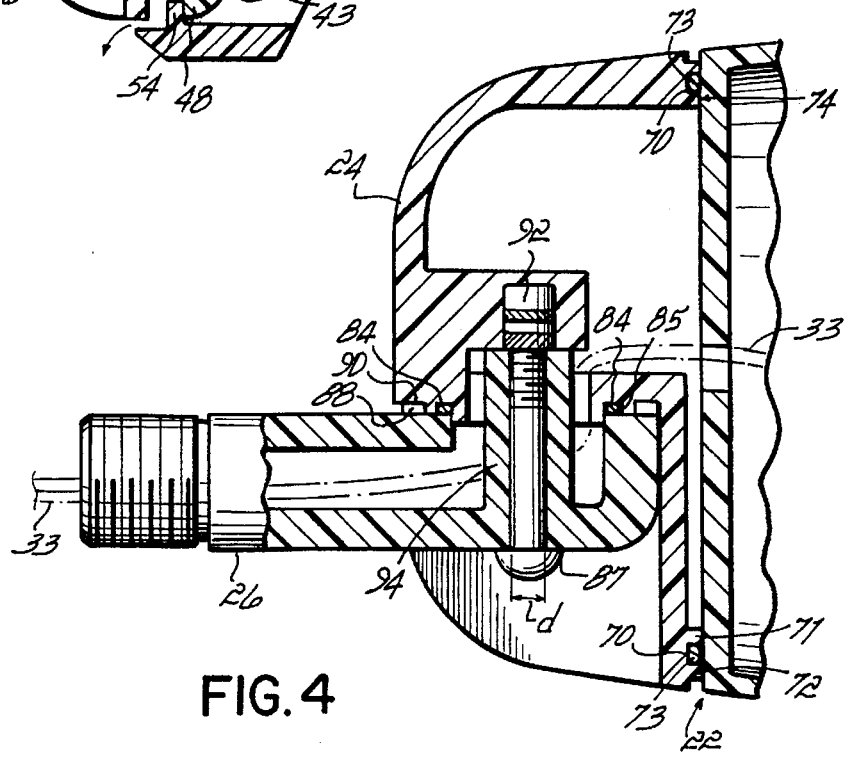
FIG. 4 is a cross-section taken along lines 4—4 of FIG. 2.

The embodiment of the light fixture 10 illustrated in FIGS. 1 and 2 utilizes an end cap 24 for sealing an open rear end 22 of housing 12. End cap 24 utilizes a similarly constructed compression-limiting sealing structure as discussed above. Referring to FIG. 4, cap 24 includes a channel 70 with opposite channel walls 71, 72 and containing a compressible seal 73. The open rear end 22 includes a sealing surface 74 which engages the channel walls 71 and 72 to compress seal 73 in channel 70. The height of the walls 71, 72 limits the compression of seal 73 when the cap 24 is secured to housing 12, such as by screws 75 or other suitable fasteners. In that way, the open rear end of the housing is dosed and sealed with a unique compress-limiting design to prevent over-compression and under-compression of seal 73.

Figure 5:
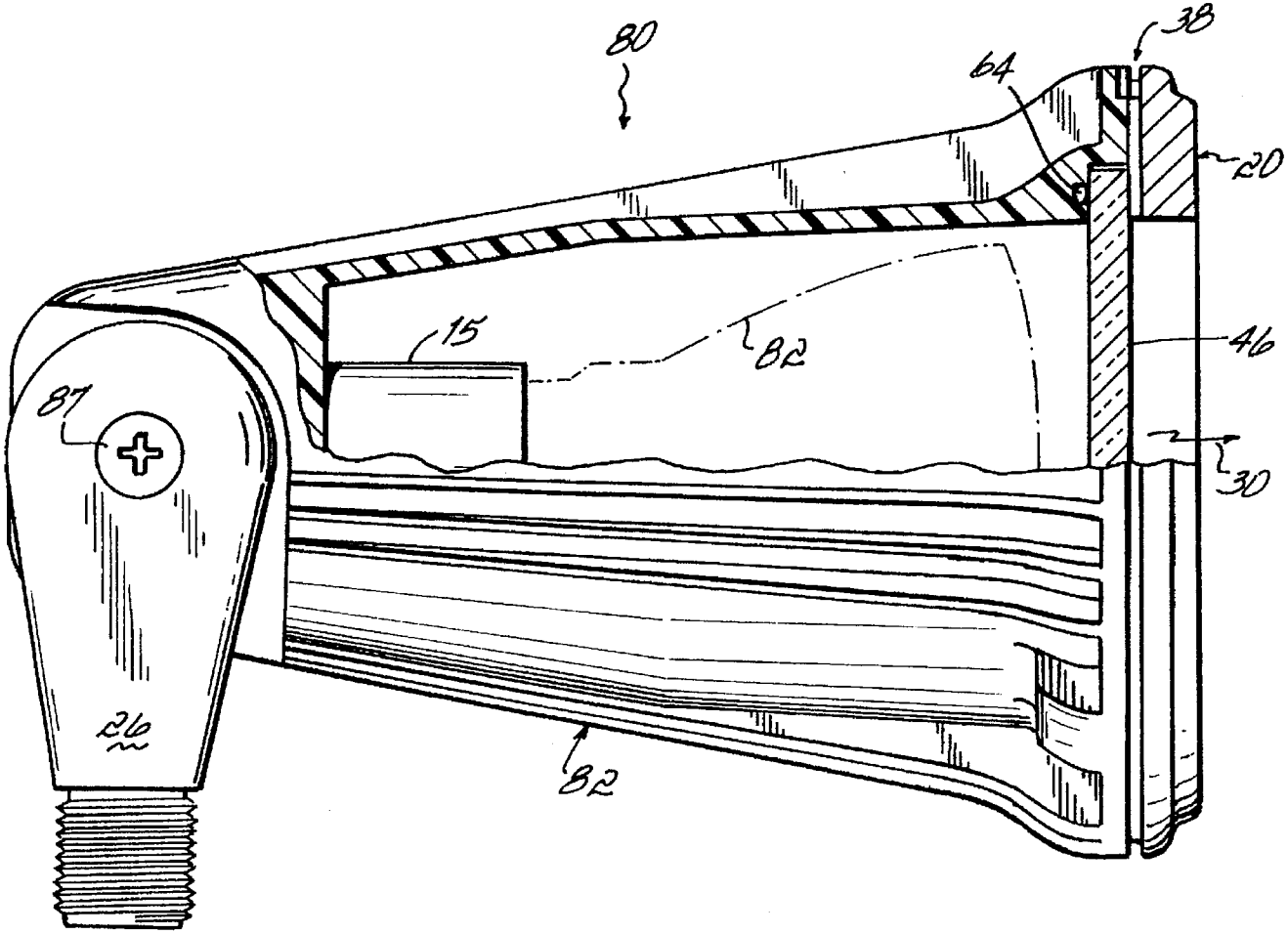
FIG. 5 is a side view and partial cross-section of an alternative embodiment of the light fixture of the invention.

An alternative light fixture 80 is illustrated in FIG. 5 and is generally smaller than light fixture 10 and thus does not require an end cap 24 but has a unitary sealed housing 82. As illustrated in FIG. 5, light fixture 80 also has the unique drainage ducts of the invention and includes an open end which must be properly sealed with the compression-limiting sealing structure of the present invention. As mentioned above, the light fixture 80 utilizes a fiat, plate glass lens 46 to seal the housing 82. The fixture of FIG. 5 preferably includes a bulb 83 which incorporates a reflector (not shown). Alternatively, a separate reflector, similar to reflector 31 of FIG. 2, might be used with fixture 80.

Lighting fixtures 10 and 80 are attached to an adjustable support arm 26 for angular adjustment of the fixtures and respective lamp beams 30. To further seal the fixtures, the unique compression-limiting sealing structure of the present invention is also utilized at the interface between the housing and the support arm 26. The support arm structure 26 is described with respect to FIGS. 2 and 4; however, it should be understood that the fixture 80 of FIG. 5 utilizes a similar arm 26.

Referring to FIG. 4, the cap 24 (or housing 82 in the case of fixture 80) has a channel 84 formed therein similar to channels 60 and 70 except smaller. A compressible seal 85 is placed therein and arm 26 has a sealing surface 86 which compresses seal 85 properly and consistently when support arm 26 is fixed to the light fixture such as by a screw 87 or other fastener. Arm 26 includes a ring of ratchet teeth 88 which cooperate with another ring of ratchet teeth 90 on cap 24 or housing 80 for adjustment of the light fixture of the invention. Screw 87 is loosened, so that the ratchet teeth 88, 90 can separate and allow housing 12 to rotate with respect to arm 26. When the housing has been moved to the chosen position, the screw 87 is tightened into an insert 92 thus bringing the teeth 88 and 90 together to prevent further rotation. To prevent damage to the light fixture when screw 87 is overtightened, a threaded insert 92 is preferably metal and fits within a section of cap 24 or an appropriate portion (not shown) of housing 80. Arm 26 has a post structure 94 through which screw 87 passes. The inner diameter of the post structure 94 is smaller than the outer diameter of the insert 92. Therefore, when screw 87 is tightened, the insert 92 will be pulled toward the head of screw 87, but post 87 will abut the insert 92 and prevent it from being pulled out. The wires 33 to socket 15 extend through the cap 24 and arm 26 to connect to an appropriate power supply (not shown).

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, the fixtures are shaped to have circular cross sections; and the lenses and retaining rings are circular. Alternatively, the fixtures may be square so that the lenses and retaining rings are square. The use of the term "ring" and "annular" are not to be confined or limited to circular rings or surfaces. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A light fixture for outdoor use comprising:

a housing defining an interior space therein and having an open end, the housing interior space configured for containing and supporting a lamp bulb to shine a beam out of the open end of the housing;

a lens configured to fit over the open end of the housing to close the housing and allow a portion of the beam to pass therethrough;

a lens retaining ring engaging the lens and securing the lens to the housing to seal the interior space and protect the lamp bulb from exposure to water;

a plurality of drainage ducts formed in the lens retaining ring and communicating with an outer face surface of the lens one of at the face surface and below the face surface, the drainage ducts receiving water which flows on the outer face surface and directly draining the water away from the face surface to effectively prevent water accumulation on the lens and obstruction of the beam portion passing through the lens;

whereby to improve the operation and durability of the light fixture.

2. The light fixture of claim 1 wherein the drainage ducts are formed in the lens retaining ring around the perimeter thereof to drain water from the lens face surface from various positions around the lens.

3. The light fixture of claim 1 wherein the lens retaining ring includes an inner wall and an outer wall, the drainage ducts comprising cooperative inner and outer portions formed in the inner and outer walls, respectively, the inner and outer duct portions cooperating to drain water from the lens face surface and through the retaining ring walls.

4. The light fixture of claim 3 wherein the inner and outer duct portions are at least partially outwardly aligned for direct draining of water from the lens face surface.

5. The light fixture of claim 1 further comprising a glare shield surrounding the open end of the housing, the glare shield including an inwardly extending ridge around a perimeter of the shield, the retaining ring and housing forming a groove around the open end which receives the ridge to secure the shield to the housing without additional fasteners.

6. The light fixture of claim 5 wherein the housing includes at least one duct formed therein proximate the shield groove, the housing duct communicating with a drainage duct in the retaining ring to drain water from the lens surface when the glare shield is secured to the housing and the shield ridge is positioned in the groove.

7. The light fixture of claim 5 wherein the housing includes an annular surface surrounding the open end and the retaining ring comprises an outwardly extending flange surrounding a portion of the ring, the ring flange and annular surface cooperating to form said groove to receive the shield ridge.

8. The light fixture of claim 1 further comprising a channel surrounding a perimeter of the housing open end and a compressible seal resting within the channel, a portion of the lens spanning the channel to compress the seal into the channel, the channel including walls which contact the lens portion and limit the compression of the seal such that proper and consistent compression of the seal is provided by securement of the lens for sealing the housing.

9. The light fixture of claim 1 wherein the housing includes an open rear end opposite said open end and further comprises a cap coupled to the housing to close the housing at the open rear end.

10. The light fixture of claim 9 wherein the cap includes a channel formed around a perimeter surface thereof and a compressible seal resting within the channel, the seal being compressed into the channel when the cap is coupled to a sealing surface of the housing, the channel including walls which contact the sealing surface and limit the compression of the seal such that proper and consistent compression of the seal is provided by coupling the cap to the housing.

11. The light fixture of claim 1 further comprising a support arm coupled to the housing at an end opposite the open end, the support arm being adjustable in angular orientation with respect to the housing to control the direction of a beam from the light fixture.

12. The light fixture of claim 11 wherein the housing includes a channel formed in a portion thereof, a compressible seal resting within the channel and being compressed into the channel by a sealing surface of the support arm when the arm is coupled to the housing, the channel including walls which contact the sealing surface and limit the compression of the seal such that proper and consistent compression of the seal is provided by coupling the arm to the housing.

13. A light fixture for outdoor use comprising:

a housing defining an interior space therein and having an open end, the housing interior space configured for containing and supporting a lamp bulb to shine a beam out of the open end of the housing;

a lens configured to fit over the open end of the housing to close the housing and allow a portion of the beam to pass therethrough;

a lens retaining ring engaging the lens and securing the lens to the housing to seal the interior space and protect the lamp bulb from exposure to water;

the housing including an annular surface surrounding the open end and the retaining ring comprising an outwardly extending flange surrounding a portion of the ring, the ring flange and annular housing surface cooperating to form a groove surrounding the lens when the retaining ring secures the lens to the housing;

a glare shield surrounding the open end of the housing, the glare shield including an inwardly extending ridge around a perimeter of the shield, the ridge extending into said groove and securing the shield to the housing without additional fasteners.

14. The light fixture of claim 13 further comprising a plurality of drainage ducts formed in the lens retaining ring and communicating with an outer face surface of the lens, the drainage ducts receiving water which flows on the outer face surface and draining the water away from the surface to prevent water accumulation on the lens and obstruction of the beam portion passing through the lens.

15. The light fixture of claim 14 wherein the lens retaining ring includes an inner wall and an outer wall, the drainage ducts comprising cooperative inner and outer portions formed in the inner and outer walls, respectively, the inner and outer duct portions cooperating to drain water from the lens face surface and through the retaining ring walls.

16. The light fixture of claim 14 wherein the housing includes at least one duct formed in the annular surface proximate the shield groove, the housing duct communicating with a drainage duct in the retaining ring to drain water from the lens surface when the glare shield is secured to the housing and the shield ridge is positioned in the groove.

17. The light fixture of claim 13 further comprising a channel surrounding a perimeter of the housing open end and a compressible seal resting within the channel, a portion of the lens spanning the channel to compress the seal into the channel, the channel including walls which contact the lens portion and limit the compression of the seal such that proper and consistent compression of the seal is provided by securement of the lens for sealing the housing.

18. A light fixture for outdoor use comprising:

a housing defining an interior space therein and having an open end, the housing interior space configured for containing and supporting a lamp bulb to shine a beam out of the open end of the housing;

a lens configured to fit over the open end of the housing to close the housing and allow a portion of the beam to pass therethrough;

a plurality of drainage ducts formed proximate the perimeter of the lens and communicating with an outer face surface of the lens one of at the face surface and below the face surface, the drainage ducts receiving water which flows on the outer face surface and directly draining the water away from the face surface to effectively prevent water accumulation on the lens and obstruction of the beam portion passing through the lens.

19. The light fixture of claim 1 wherein the lens has a face surface and a perimeter rim positioned below the lens face surface, the drainage ducts communicating with said perimeter rim for draining said water.

* * * * *

UNITED STATES PATENT AND TRADEMARK OFFICE

CERTIFICATE OF CORRECTION

PATENT NO. : 5,651,606

DATED : July 29, 1997

INVENTOR(S) : Mark J. Krogman

It is certified that error appears in the above-identified patent and that said Letters Patent is hereby corrected as shown below:

In Column 1, line 27 delete "dosed" and insert --closed--.

In Column 1, line 33 delete "dose" and insert --close--.

in Column 2, line 3 delete "fiat" and insert --flat--.

In Column 2, line 12 delete "fiat" and insert --flat--.

In Column 2, line 16 delete "fiat" and insert --flat--.

In Column 2, line 17 delete "fiat" and insert --flat--.

In Column 2, line 20 delete "fiat" and insert --flat--.

In Column 2, line 64 delete "dose" and insert --close--.

In Column 3, line 1 delete "fiat" and insert --flat--.

In Column 3, line 14 delete "fiat" and insert --flat--.

In Column 3, line 45 delete "ting" and insert --ring--.

In Column 5, line 10 delete "dear" and insert --clear--.

UNITED STATES PATENT AND TRADEMARK OFFICE

CERTIFICATE OF CORRECTION

PATENT NO. : 5,651,606

DATED : July 29, 1997

INVENTOR(S) : Mark J. Krogman

It is certified that error appears in the above-identified patent and that said Letters Patent is hereby corrected as shown below:

In Column 5, line 20 delete "dosed" and insert --closed--

In Column 5, line 36 delete "duds" and insert --ducts--.

In Column 5, line 49 delete "fiat" and insert --flat--.

In Column 6, line 17 delete "fiat" and insert --flat--.

In Column 7, line 5 delete "10 in" and insert --when--.

In Column 7, line 35 delete "dosed" and insert --closed--.

In Column 7, line 45 delete "fiat" and insert --flat--.

Signed and Sealed this

Seventeenth Day of March, 1998

*Attest:*

*Attesting Officer*

BRUCE LEHMAN

*Commissioner of Patents and Trademarks*